US005927905A

United States Patent [19]

van Halteren

[11] Patent Number: 5,927,905

[45] Date of Patent: Jul. 27, 1999

[54] METHOD FOR APPLYING A GROUND ANCHOR INTO THE GROUND AND ANCHOR TO BE USED THEREWITH

[76] Inventor: Tijmen van Halteren, Dorpsweg 142, Bunschoten, Netherlands, 3751

[21] Appl. No.: 09/000,475

[22] PCT Filed: Aug. 2, 1996

[86] PCT No.: PCT/NL96/00315

§ 371 Date: Feb. 3, 1998

§ 102(e) Date: Feb. 3, 1998

[87] PCT Pub. No.: WO97/06311

PCT Pub. Date: Feb. 20, 1997

[30] Foreign Application Priority Data

Aug. 8, 1995 [NL] Netherlands ..... 1000951

[51] Int. Cl.[6] ..... E02D 5/10; E02D 5/74

[52] U.S. Cl. ..... 405/252.1; 405/244; 405/262; 405/241; 52/157; 52/153

[58] Field of Search ..... 405/237, 239, 405/241, 242, 244, 252.1, 253, 262; 52/153, 157, 163

[56] References Cited

U.S. PATENT DOCUMENTS

| | | | |
|---|---|---|---|
| 2,603,319 | 7/1952 | Dyche | 175/394 |
| 3,628,337 | 12/1971 | Stepanich | 405/253 |
| 4,611,446 | 9/1986 | Beavers et al. | 52/163 |
| 4,727,693 | 3/1988 | Rockenfeller et al. | 52/163 |
| 5,322,386 | 6/1994 | Trangsrud | 405/244 X |
| 5,348,424 | 9/1994 | Tateyama et al. | 405/262 |

*Primary Examiner*—Tamara Graysay
*Assistant Examiner*—Jong-Suk Lee
*Attorney, Agent, or Firm*—Michael D. Bednarek; Crowell & Moring LLP

[57] ABSTRACT

A method for and inserting a ground anchor into the ground, comprising the step of screwing an elongated anchor body into the ground by means of an extension tube that is to be connected to the proximal end of the anchor body. The distal end of a tension line is connected to the anchor body above the screw blade turns. A pipe sleeve is slid onto the extension tube, while guiding the tension line via an eyelet at the pipe sleeve adjacent to the distal end of the pipe sleeve, from the anchor body along the pipe sleeve. The anchor body is then screwed downwardly by turning the extension tube and the pipe sleeve jointly to a predetermined depth. Finally, the pipe sleeve together with the line extending there along are rotated around the stationary anchor body/extension tube assembly.

4 Claims, 1 Drawing Sheet

METHOD FOR APPLYING A GROUND ANCHOR INTO THE GROUND AND ANCHOR TO BE USED THEREWITH

FIELD OF THE INVENTION

The invention relates to the field of ground anchors that are capable of balancing the forces to which building structures are subjected. For example, sheet pile walls, which are driven into the ground at building sites, need to be stabilized by ground anchors, which are capable of generating pulling forces that are large enough to compensate for lateral ground pressure exerted on the sheet pile wall.

BACKGROUND OF THE INVENTION

According to well-known methods, an anchor is inserted in the ground by making use of an anchor body having a hollow core and screw blades, which is screwed into the ground with the aid of one or more extension tubes. The extension tube is connected to the proximal end of the anchor body and rotated until the anchor body has reached a desired depth. A settable mortar is then introduced and forced through the extension tube(s) and through the hollow space of the anchor body into the soil between the screw blade turns, so as to form, together with the soil, a solid mass, in which the anchor body becomes fixedly anchored.

The extension tubes form a permanent part of the anchor and are attached to the structure to be stabilized, e.g., a sheet-pile wall, with the proximal end extending through a hole in the sheet-pile wall, thus becoming the intermediary of an anchoring support.

In general, the insertion of the required ground anchors into the ground is started only after the sheet-pile wall is completed. The introduction of the individual sheet-piles involves powerful vibrations, which are transmitted through the earth. If one were to start the insertion of the ground anchors, while continuously driving additional sheet-piles into the ground, the vibrations would prevent an effective setting process for the settable mortar, thus the required pull out resistance would not be obtained.

SUMMARY OF THE INVENTION

It is an object if the invention to provide an improved method of inserting a ground anchor into the ground. A further object of the invention is to provide such an insertion method that can be carried out before a structure, e.g., sheet pile, to be stabilized, has been completed and immediately upon the insertion of each subsequent sheet-pile(s), so that the overall time required for inserting structures into the ground and anchoring the same, may be substantially reduced.

The invention provides a method for inserting a ground anchor into the ground, comprising the step of screwing an elongated anchor body into the ground by making use of an extension tube that is connected to the proximal end of the anchor body and then rotated until the anchor body has reached a predetermined depth. A predetermined depth is such depth which is commonly recognized within the field of invention as that which would ensure the stability of the structure being stabilized, i.e., the depth at which a pulling load would be below that which would be necessary to completely pull out the ground anchor.

Also included in the present invention are the additional steps of connecting one end of a tension line to the anchor body at a location spaced above the screw blade turns of the anchor body, sliding a pipe sleeve over the extension tube, while threading the line through an eyelet that is fixed adjacent the distal end of the pipe sleeve and guiding the line along the pipe sleeve, rotating the extension tube and the pipe sleeve jointly until the anchor body has reached a desired depth. Subsequently, the extension tube should be immobilized to prevent further rotation of the same while continuing rotation of the pipe sleeve so as to cause the line to be gradually led out through the pipe sleeve downwardly and wind itself into a coil on the proximal end portion and/or the distal end portion of the extension tube.

Through the coil formed on the proximal end portion of the anchor body and/or the distal end portion of the extension tube connected thereto, an increase is effected of both the mass and the diameter of the anchor body, which results in a correspondingly increased "hold" of said anchor body. It should be noted that the coil winding process involves a compression of the soil at the coil winding location.

As compared with the well-known method, above referred to, use of a settable mortar is omitted, thus fulfilling the condition under which it is permissible to immediately insert the anchors each time after a sheet-pile has been driven into the ground.

By placing a ground anchor into the ground at the location of each sheet-pile, use can be made of relatively low tensile strength ground anchors, while it is also no longer necessary to place supporting beams along the outer side of the sheet-pile walls, as is required when using ground anchors with mutual spacings that are many times larger than the width of an individual sheet-pile.

It should be noted that U.S. Pat. No. 2,603,319 discloses an auger type ground anchor, with which the distal end of a line is fastened to a laterally extending eyelet of a sleeve that is rotatably mounted about either an upper smooth section of the shaft of the anchor body or about an extension thereof. Regarding the present invention, when in the process of screwing the anchor into the ground, the anchor is lowered to an extent that the desired sleeve location is just about to enter the ground, and then the sleeve is attached and the line is fastened. The lowering, by rotation, of the anchor may then be continued, whereby the sleeve will swivel on the rotating anchor shaft, i.e., extension, and the line will cut its way downwards through the ground. In the present invention, the line is forming the object that is to be anchored. There is no question that the line that is coiled upon the anchor body increase both its mass and diameter, thereof.

The invention also provides a ground anchor for use with the above method, said ground anchor comprising an elongated anchor body having a distal end and a proximal end, and an extension tube having a distal end that is connected to the proximal end of the anchor body and a proximal end adapted to be connected to a rotating means for driving said anchor body into the ground, wherein a tension line is connected to the anchor body at a location spaced below the proximal end of the body. Further, the extension tube is surrounded by a pipe sleeve having distal and proximal ends, wherein said pipe sleeve having a guiding eyelet adjacent its distal end, the line being threaded through the guiding eyelet and guided along the pipe sleeve towards and beyond the proximal end of the latter. Further wherein, the pipe sleeve being adapted to be connected to the rotating means so as to be selectively rotated by the driving means either independently or in unison with the extension tube.

In a preferred embodiment, the anchor body has a supporting flange at the line connection location and said line is guided through the clearance space between the pipe sleeve and the extension tube.

The invention will be hereinafter further explained by way of example with reference to the accompanying diagrammatic drawing FIG. 1.

DESCRIPTION OF THE PREFERRED EMBODIMENTS

Figure 1:
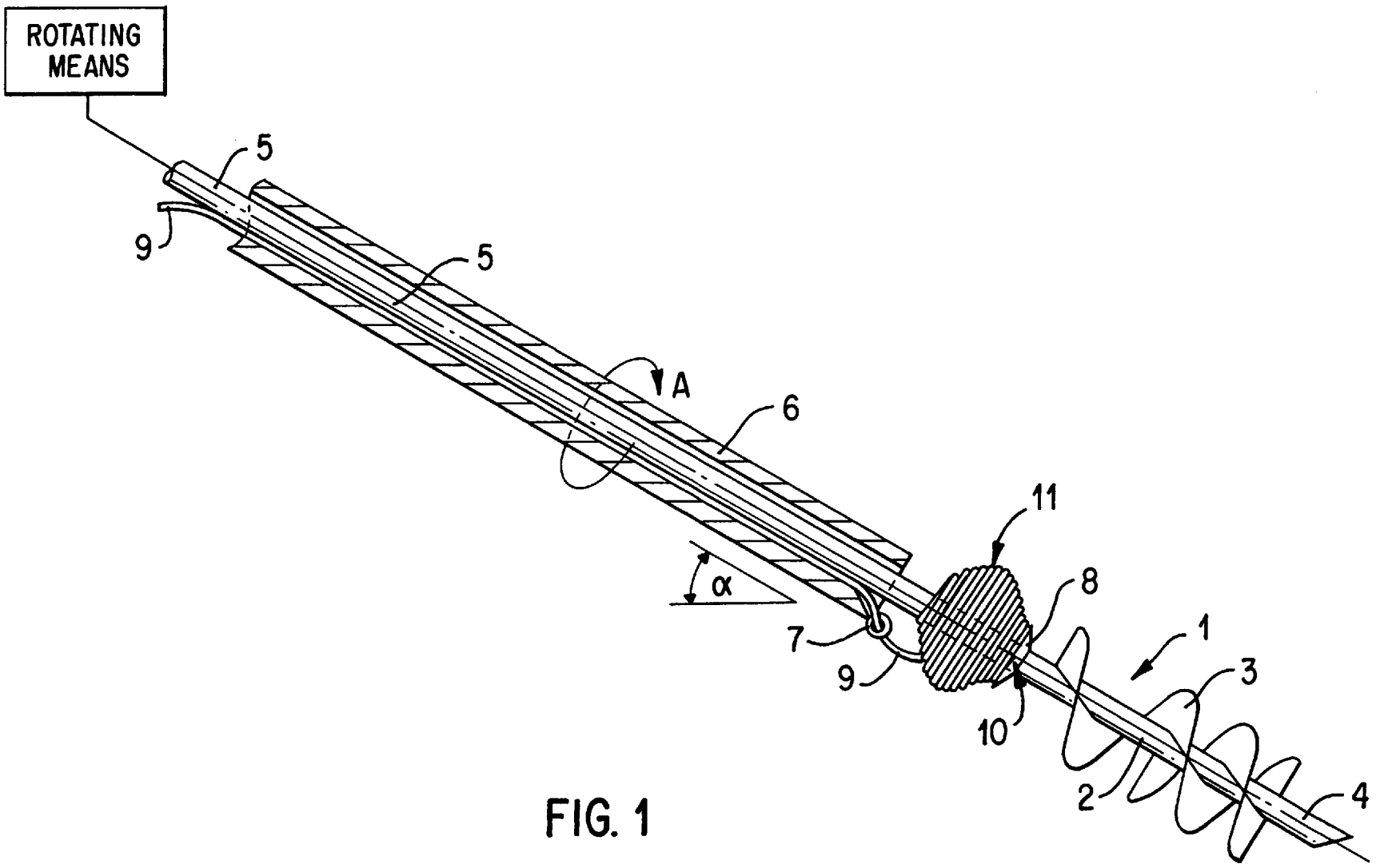
FIG. 1 is a side view of an anchor, according to the present invention, in a position under an elevational angle α, that is taken of the anchor body relative to the horizontal plane during its insertion into the ground.

The anchor shown in the drawing has to be driven into the ground under an elevational angle α, e.g. 25–40°. It comprises an anchor body 1 in the form of a core rod 2 that is provided with a screw blade 3, in a well-known manner, and terminates at its distal end into a beveled frog 4.

An extension tube 5 is connected to the proximal end of the anchor body 1. In the example shown the extension tube is indicated as integrally formed with the core rod 2.

The extension tube 5 is surrounded by a pipe sleeve 6, that has a guiding eyelet 7 at its distal end.

A flange 8 is provided on the core rod 2 at the transition between said core rod and the extension tube 5. The distal end of a steel wire cable 9 is anchored on the side of the flange that is turned away from the frog 4. When the anchor is ready for being driven into the ground, the cable 9 extends from the anchoring location 10 straight through the guiding eyelet 7 and the clearance space between the extension tube 5 and the pipe sleeve 6 towards the anchor end turned away from the frog 4. In this condition the anchor is screwed into the ground in a well-known manner, under the desired elevational angle α, by rotating the extension tube 5 and the pipe sleeve 6 jointly in the arrow direction A by means of a driving device (not shown) positioned above ground level.

When the ground anchor has reached at the predetermined depth, the extension tube 5 is disconnected from the driving device and thus left stationary after which the pipe sleeve is further rotated around the stationary extension tube 5. This causes the line 9 to be gradually paid out through the pipe sleeve 6 and through the eyelet 7 downwardly and wind itself to a coil 11 that bears against the flange 8. Upon completion of the coil winding process the sleeve 6 is held against further rotation, after which the anchor may be connected with its upper projecting end portion to the structure to be stabilized.

By the coil formed at the line connection location of the anchor body, an increase is obtained in both the mass and diameter of the anchor body, which results in an increased "hold" of the anchor.

I claim:

1. A method for inserting a ground anchor into the ground, comprising the steps of:

connecting an extension tube to a proximal end of an elongated anchor body;

screwing the elongated anchor body into the ground by means of the extension tube having proximal and distal ends;

rotating the anchor body until the anchor body reaches a first predetermined depth;

connecting one end of a tension line to the anchor body at an attachment point between the two ends of the anchor body;

sliding a pipe sleeve having a distal end over the extension tube, while threading the tension line through an eyelet that is fixed adjacent the distal end of the pipe sleeve and guiding the tension line in an upward direction along the pipe sleeve;

rotating the extension tube and the pipe sleeve jointly until the anchor body reaches a second predetermined depth;

holding the extension tube to prevent further rotation of the extension tube while continuing rotation of the pipe sleeve so as to cause the tension line to be gradually pulled in a downward direction through the pipe sleeve and wind the tension line into a coil on the proximal end portion of the anchor body and/or the distal end portion of the extension tube.

2. A ground anchor comprising:

an elongated anchor body having proximal and distal ends;

an extension tube having proximal and distal ends;

a pipe sleeve having proximal and distal ends;

wherein the extension tube having the distal end connected to the proximal end of the anchor body, further wherein the proximal end of the extension tube is adapted to be connected to a rotating means for driving the anchor body into the ground;

wherein a tension line is connected to the anchor body at an attachment point located between the proximal and distal ends of the anchor body;

the extension tube being surrounded by a pipe sleeve having distal and proximal ends;

the pipe sleeve having a guiding eyelet adjacent the distal end of the pipe sleeve, wherein the tension line being threaded through the guiding eyelet and guided along said pipe sleeve towards and beyond the proximal end of the anchor body;

the pipe sleeve being adapted to be connected to the rotating means so as to be selectively rotated by the rotating means independently or in unison with the extension tube.

3. The ground anchor according to claim 2, wherein the anchor body has a supporting flange tangential to the tension line attachment point.

4. The ground anchor according to claim 2, wherein the tension line is guided through a clearance space between the pipe sleeve and the extension tube.

* * * * *